United States Patent [19]

Zitz et al.

[11] Patent Number: 4,875,738

[45] Date of Patent: Oct. 24, 1989

[54] ARM-SUPPORTED CUTTING ROLL WITH EFFECTIVE LENGTH PIVOTALLY ADJUSTABLE ALONG MINING FACE

[75] Inventors: Alfred Zitz, Zeltweg; Erich Brandl, Grosslobming, both of Austria

[73] Assignee: Voest-Alpine Maschinenbau Gesellschaft m.b.H., Linz, Austria

[21] Appl. No.: 261,893

[22] Filed: Oct. 25, 1988

[30] Foreign Application Priority Data

Oct. 29, 1987 [AT] Austria ..... 2856/87

[51] Int. Cl.[4] ..... F21C 27/24

[52] U.S. Cl. ..... 299/80; 175/267

[58] Field of Search ..... 299/61, 71, 80, 88, 299/89; 37/189, 190; 175/267

[56] References Cited

U.S. PATENT DOCUMENTS

Re. 31,622 7/1984 Todd ..... 299/1
3,730,593 5/1973 Karlovsky, Jr. ..... 299/76
4,172,616 10/1979 Delli-Gatti, Jr. ..... 299/89

FOREIGN PATENT DOCUMENTS 886511 1/1962 United Kingdom ..... 299/89
2021664 12/1979 United Kingdom ..... 299/80
748007 7/1980 United Kingdom ..... 299/80

*Primary Examiner*—Jerome W. Massie, IV
*Assistant Examiner*—David J. Bagnell
*Attorney, Agent, or Firm*—Cushman, Darby & Cushman

[57] ABSTRACT

In a cutting or hewing roll there is, for increasing the cutting width, arranged at least one lateral front surface of the roll a tool carrier being swivellable relative to the axis of the cutting or hewing roll and receiving hewing or cutting tools. For the purpose of swivelling the swivellable tool carrier there is preferably provided a cylinder-piston-aggregate arranged within the interior of the roll and extending essentially in parallel relation to the axis of rotation of the roll.

5 Claims, 2 Drawing Sheets

ARM-SUPPORTED CUTTING ROLL WITH EFFECTIVE LENGTH PIVOTALLY ADJUSTABLE ALONG MINING FACE

BACKGROUND OF THE INVENTION

1. Field of the Invention

The invention relates to a cutting or hewing roll, the cutting length of which is pivotally adjustable.

2. Description of the Prior Art

For the purpose of increasing the cutting length of cutting rolls it is already known to provide roll sections which are telescopically shiftable in an axial direction, i.e. which are shiftable along the axis of rotation of the cutting roll and being arranged for being fixed in its respective adjusted position. Such telescopically expandable and retractable roll sections require a relatively expensive drive means and the support of such telescopically expandable parts must be designed in a manner which, on the one hand, permits axial shifting movement and which, on the other hand, reliably provides for a positive rotary connection with the remaining parts of the roll. On account of the required shiftability in axial direction, the positive rotary connection must be given a certain amount of play, which results in a high wear of such driving connections. The variability of the cutting width (i.e. of cutting roll effective length) primarily serves the purpose to improve the maneuvrability of the whole machine and shall provide the possibility to prevent any hindrance by already positioned consolidating props or the like when travelling along curves of smaller radius of curvature or through more narrow drift sections of a mine.

Known devices of the initially mentioned type, in which roll parts are shiftable in direction of the axis of rotation of the cutting roll or hewing roll and are supported for positive rotary connection with a roll part which is part non-shiftably supported, may, for example, be learned from U.S. Pat. No. 4,172,616.

SUMMARY OF THE INVENTION

The invention now aims at providing a simple and operationally safe construction, which allows a particularly short constructional length and in which the support means and the guide means for the parts for varying the cutting width is of more simple design. For solving this task, the arrangement according to the invention essentially consists in that a tool carrier which is swivellable (i.e. pivotable crosswise of) relative to the axis of the cutting or hewing roll is provided. This tool carrier is adapted for receiving hewing tools or cutting tools and is arranged at least at one end of the roll. On account of a tool carrier being swivellably arranged on the cutting or hewing roll, it is possible to omit expensive sliding guides and to make sure with this device that no non-worked gaps of an excessive dimension remain at the drift face when swivelling the tool carrier. On account of swivelling the tool carrier or, respectively, giving same an inclined position, the cutting or hewing tools arranged on the tool carrier assume, as seen in the axial direction, an adjacent position so that mutually parallelly extending tracks are cut or fractured by the cutting or hewing tools during swivelling movement at the drift face. Of course, the distance of these cut or fractured tracks is variable depending on the swivelling angle, and, in case of a greater degree of swivelling movement and thus a greater increase of the cutting width it must be made sure that a greater amount of rock can be fractured, so that no great ribs remain between the grooves. Because fracturing work does, as a rule, require a lower amount of energy than cutting work, a relatively great increase of the cutting width can be achieved without varying the driving power in case of fragile rock.

Advantageously, the arrangement is, according to the invention, such that the swivellable tool carrier is swivelably linked in proximity of the circumference of the roll for swivelling movement around an axis tangentially extending relative to this circumference or intersecting this circumference. Such an arrangement provides the possibility, as is in accordance with a further preferred embodiment of the invention, to give the tool carrier a substantially plate-like shape and to arrange the cutting or hewing tools on the circumference of the tool carrier. By means of such a tool carrier, which is swivellably linked in proximity of the circumference of the roll, it is possible to obtain a relatively great increase of the cutting width, noting that the tool carrier requires an only small laterally extending space in its (i.e. maximally retracted) position, i.e. in a swivelled position extending in essentially normal relation to the axis of rotation. Furthermore, the tool carrier of plate-like shape provides the possibility to close the cutting roll at its front ends and the drive means for swivelling the tool carrier may be housed in a protected manner within the interior of the cutting roll. In this case, the arrangement is advantageously selected such that a cylinder-piston-aggregate arranged within the interior of the roll in approximately parallel relation to the axis of rotation of the roll is provided for swivelling the swivellable tool carrier. In this manner, there results a particularly compact construction with a relatively great adjustability of the effective cutting roll length. Simultaneously, the driving equipment for the roll is protected against becoming damaged.

In a particularly advantageous manner, the arrangement may be such that the swivelling axis of the swivellable tool carrier crosses at a normal angle the axis of rotation of the hewing roll or, respectively, cutting roll, noting that in case of such a swivelling axis, being arranged in proximity of the circumference, of the tool carrier only provision must be made that the constructional parts for bearingly supporting the swivelling axis do not directly contact the rock to be excavated which would result in wear of these constructional parts. This can be prevented in a simple manner by designing the bearing means such that the hewing tools or cutting tools engage over in radial direction, relative to the axis of rotation of the cutting roll or hewing roll, the constructional parts of the bearing means for swivelling the tool carrier, so that the tips of the bits rotate along a greater circumference than the constructional parts of the bearing means for swivelling the tool carrier.

BRIEF DESCRIPTION OF THE DRAWING

In the following, the invention is further explained with reference to an embodiment schematically shown in the drawings.

In the drawings

DETAILED DESCRIPTION OF THE PREFERRED EMBODIMENT

Figure 1:
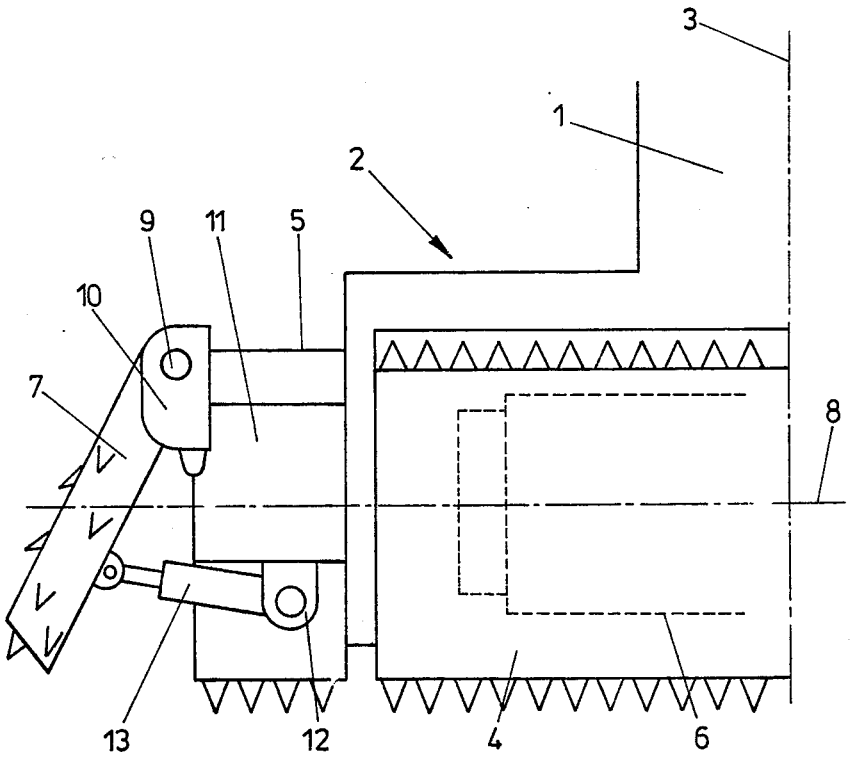
FIG. 1 shows a schematic partial top plan view of the inventive construction of the cutting roll or hewing roll, respectively.

In FIG. 1, there is shown a cutting arm 1 in a schematic top plan view of an inventive construction of the cutting roll or, respectively, hewing roll (In this document, for the sake of simplicity, the roll will sometimes be designated a cutting roll, and the tools mounted thereto cutting tools, without regard to whether, from a technical viewpoint, the roll or tools actually perform primarily as cutters, hewers, fracturers or the like.) The whole cutting roll 2 is completed by an arrangement located symmetrically about the center axis, indicated by reference numeral 3, of the cutting arm 1. The cutting roll 2 consists of a respective roll-shaped central portion 4 as well as of opposite end portions 5. The end portions 5 are rigidly connected with the central roll 4. Gearing located within the interior of the central portion of the cutting roll 4 for rotating the roll relative to the arm is indicated by the reference numeral 6. As is schematically shown in FIG. 1, the inventive cutting roll 2 has at its outer end of each end portion 5 a swivellable tool carrier 7, which is arranged on a bearing block 10 for being swivellable around an axis 9 relative to the axis 8 of rotation of the cutting roll 2. The bearing block 10 is supported on a constructional part 11 rigidly connected with the central portion of the cutting roll and located within the interior of respective end portion 5 of the cutting roll. The constructional part 11 has a linking joint 12 for a cylinder-piston-aggregate 13 for effecting swivelling movement of the swivellable tool carrier 7. In the inwardly swivelled (i.e. fully retracted) condition of the tool carrier 7, i.e. a tool carrier being formed of a plate member extending in essentially normal relation relative to the axis 8 of rotation of the cutting roll 2, the cylinder-piston-aggregate 13 is arranged within the interior of the lateral portion 5 of the cutting roll in an approximately parallel orientation relative to this axis 8 of rotation. The portions 4 and 5 of the cutting roll as well as the tool carrier 7 have hewing tools or cutting tools on their respective outer circumferences.

Figure 2:
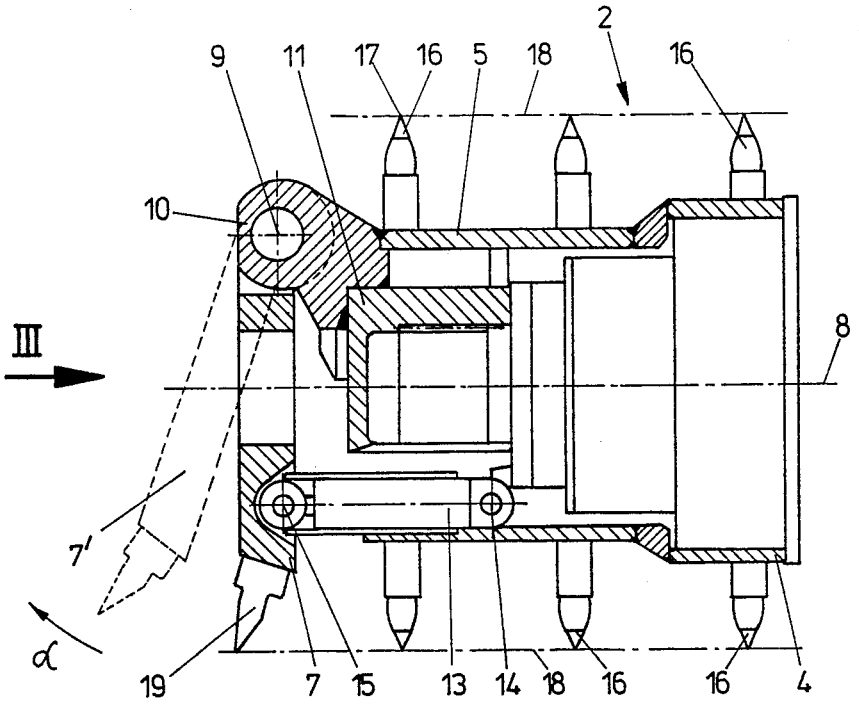
FIG. 2 shows, partially in an axial section, a partial view of the expandable portion of the hewing roll or, cutting roll, respectively.

In the view of the expandable part of the cutting roll 2 shown in FIG. 2, the reference numerals used in FIG. 1 are used again. The inwardly swivelled position of the tool carrier 7, i.e. the position in which the plate-shaped tool carrier extends in essentially normal direction relative to the axis 8 of rotation, is designated in FIG. 2 by the reference numeral 7, whereas the outwardly swivelled position is shown in dashed lines and designated by the reference numeral 7'. The linking axes of the cylinder-piston-aggregate are designated by the reference numerals 14 and 15, respectively, in FIG. 2. Furthermore, there are shown in FIG. 2 bits 16 arranged along the circumference of the cutting roll portions 4 and 5, noting that, for the purpose of protecting the bearing block 10 for the swivellable tool carrier 7, the bit tips 17 of the bits arranged on the lateral portion 5 of the cutting roll rotate along a greater circumference, being schematically indicated by the reference numeral 18, than is the extension in radial direction of the bearing block 10 from the axis 8 of rotation of the cutting roll. A bit arranged on the tool carrier 7 is designated by 19. As can be clearly seen in FIG. 2, the swivelling axis 9 of the tool carrier 7 is arranged in proximity to the lateral portion 5 of the cutting roll, swivelling axis 9 crosses at a right angle a plane containing the axis 8 of rotation of the cutting roll.

Figure 3:
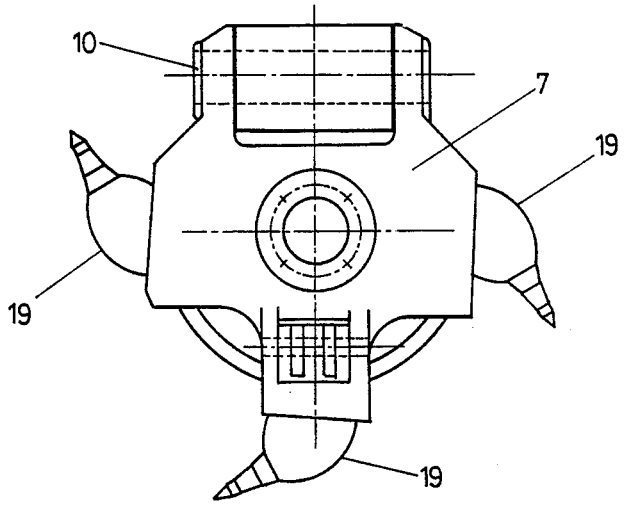
FIG. 3 shows a view in the direction of the arrow III of FIG. 2.

If, as is shown in FIG. 3, several cutting bits or cutting tools 19 , respectively, are arranged on the swivel able tool carrier 7, it becomes, when swivelling the tool carrier 7, possible to bring these bits 19 into a position in which they are, as seen in axial direction, located one beside the other, so that, when swivelling the tool carrier 7, mutually parallel extending tracks are cut or fractured by the bits 19 at the drift face. The distance of the individual tracks one from the other is, of course, dependent on the swivelling angle $\alpha$ of the tool carrier 7. For protecting the interior of the cutting roll end portion 5, sealingmeans may be provided at the side facing away from the bearing means 10 of the swovellable tool carrier 7, so that rock is prevented from entering the interior of the cutting roll end portion 5 within the area of the cylinder-piston-aggregate 13. Such sealing means are not shown for the sake of simplicity.

What is claimed is:

1. An arm-supported cutting roll having an effective length which is adjustable along a mining face, comprising:

an axially elongated cutting roll having two opposite ends;

an arm mounting said cutting roll for rotation about a longitudinal axis of said cutting roll;

said cutting roll having a plurality of cutting tools provided on a radially outer peripheral surface thereof having tips disposed for engagement, in use, with a mining face for cutting material from the mining face as the cutting roll is rotated about said axis;

means providing a swivel joint on said cutting roll, near one end thereof, said swivel joint being located closer to said longitudinal axis than are said tips of said cutting tools, said swivel joint providing a pivot axis which extends crosswise of an imaginary plane containing said longitudinal axisl;

a tool carrier mounted to said swivel joint for pivotal movement about said pivot axis between a retracted position in which said tool carrier effectively extends said cutting roll axially by a first, lesser amount, and an extended position in which said tool carrier effectively extends said cutting roll axially by a second, greater amount;

means for operating said swivel joint for pivoting said tool carrier about said pivot axis to a desired position delimited by said retracted position and said extended position;

at least one cutting rool provided externally on said tool carrier, having a tip disposed for engagement, in use, with the mining face for cutting material from the mining face as the cutting roll, and thereby the tool carrier is rotated about said axis.

2. The arm-supported cutting roll of claim 1, wherein: said cutting roll is hollow and said means for operating said swivel joint comprises an extensible and retractable piston and cylinder aggregate having one end mounted to said cutting roll internally of said cutting roll near said end, and having an opposite end connected with said tool carrier.

3. The arm-supported cutting roll of claim 2, wherein: said tool carrier is plate-shaped and arranged, when in said retracted position, to generally close said one end of said cutting roll.

4. The arm-supported cutting roll of claim 3, wherein: said pivot axis is substantially normal to said imaginary plane.

5. The arm-supported cutting roll of claim 1, wherein: said pivot axis is substantially normal to said imaginary plane.

* * * * *